US009841716B2

(12) United States Patent
Yumita et al.

(10) Patent No.: US 9,841,716 B2
(45) Date of Patent: Dec. 12, 2017

(54) ELECTROPHOTOGRAPHIC PHOTORECEPTOR, IMAGE FORMING APPARATUS, AND IMAGE FORMING PROCESS

(71) Applicant: Konica Minolta, Inc., Tokyo (JP)

(72) Inventors: Masanori Yumita, Hachioji (JP); Toshiyuki Fujita, Hachioji (JP); Daisuke Kodama, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/996,452

(22) Filed: Jan. 15, 2016

(65) Prior Publication Data

US 2016/0223976 A1 Aug. 4, 2016

(30) Foreign Application Priority Data

Feb. 4, 2015 (JP) ..... 2015-020132

(51) Int. Cl.
*G03G 5/147* (2006.01)
*G03G 15/00* (2006.01)
(Continued)

(52) U.S. Cl.
CPC ..... *G03G 15/751* (2013.01); *G03G 5/082* (2013.01); *G03G 5/142* (2013.01); *G03G 5/144* (2013.01);
(Continued)

(58) Field of Classification Search
CPC ..... G03G 5/14704
See application file for complete search history.

(56) References Cited

U.S. PATENT DOCUMENTS 9,423,707 B2 * 8/2016 Yumita ..... G03G 5/14704
2010/0232830 A1 * 9/2010 Wada ..... C09B 67/0016 399/111
(Continued)

FOREIGN PATENT DOCUMENTS

JP 2001-083727 A 3/2001
JP 2002-270861 A 9/2002
(Continued)

OTHER PUBLICATIONS

Notification of Reason for Refusal dated Jan. 17, 2017 from corresponding Japanese Patent Application No. JP 2015-020132; English translation of Notification of Reason for Refusal; Total of 9 pages.

*Primary Examiner* — Hoa V Le
(74) *Attorney, Agent, or Firm* — Lucas & Mercanti, LLP

(57) ABSTRACT

An electrophotographic photoreceptor includes an intermediate layer, a photosensitive layer, and a surface protective layer, deposited in this order on an electroconductive support. The surface protective layer includes a resin and a p-type semiconductor microparticle contained in the resin. The intermediate layer includes a resin and at least one metal oxide microparticle contained in the resin. The at least one metal oxide microparticle is selected from the group consisting of untreated tin oxide particles, tin oxide particles surface-treated with organic compounds, untreated anatase titanium oxide particles, anatase titanium oxide particles surface-treated with organic compounds, untreated rutile titanium oxide particles, and rutile titanium oxide particles surface-treated with organic compounds.

7 Claims, 2 Drawing Sheets

(51) Int. Cl.
*G03G 5/082* (2006.01)
*G03G 5/14* (2006.01)

(52) U.S. Cl.
CPC ..... *G03G 5/14791* (2013.01); *G03G 2215/00957* (2013.01)

(56) References Cited

U.S. PATENT DOCUMENTS

| | | | | |
|---|---|---|---|---|
| 2013/0157182 | A1* | 6/2013 | Fujita | G03G 5/043 430/57.1 |
| 2014/0038094 | A1* | 2/2014 | Hamaguchi | G03G 5/144 430/64 |
| 2014/0141362 | A1* | 5/2014 | Watariguchi | G03G 21/18 430/56 |

FOREIGN PATENT DOCUMENTS

| | | | |
|---|---|---|---|
| JP | 2003-255579 | A | 9/2003 |
| JP | 2006-171401 | A | 6/2006 |
| JP | 2013130603 | A | 7/2013 |
| JP | 2014021133 | A | 2/2014 |

* cited by examiner

ELECTROPHOTOGRAPHIC PHOTORECEPTOR, IMAGE FORMING APPARATUS, AND IMAGE FORMING PROCESS

BACKGROUND OF THE INVENTION

Field of the Invention

The present invention relates to an electrophotographic photoreceptor for forming electrophotographic images, an image forming apparatus, and an image forming process.

Description of Related Art

Electrophotographic photoreceptors (hereinafter, also simply referred to as "photoreceptors") for image forming apparatuses, such as electrophotographic copiers and printers, should have long service lives and form images with stable quality. The service life of a photoreceptor varies depending on the wear of the surface of the photoreceptor. In addition, fine scratches and uneven abrasion due to the wear cause a reduction in image quality.

A recently developed photoreceptor having high wear resistance, scratch resistance, and environmental stability and a prolonged service life includes a photosensitive layer deposited on an electroconductive support and a surface protective layer of a cured resin on the photosensitive layer.

In such a photoreceptor, in order to improve the wear resistance and the stability of image quality, such as high memory resistance, for example, a surface protective layer further containing high-strength microparticles having hole transportability, p-type semiconductor microparticles, has been proposed (for example, see Japanese Patent Laid-Open Nos. 2013-130603 and 2014-021133).

Even in the photoreceptor having the surface protective layer containing p-type semiconductor microparticles, however, repeated use for a long time causes a problem of occurrence of transfer memory.

For solving the problem of transfer memory, an increase in the content of the p-type semiconductor microparticles may be effective. The increase in the content of the p-type semiconductor microparticles, however, causes another problem, easy fogging. This is probably due to the low surface electrical resistance, i.e., the low potential-holding ability, of the p-type semiconductor microparticles themselves.

SUMMARY

An object of the present invention, which has been made in view of the above-described circumstances, is to provide an electrophotographic photoreceptor that shows high memory resistance and does not cause fogging, even in repeated use for a long time, an image forming apparatus including the photoreceptor, and an image forming process using the apparatus.

According to a first aspect of a preferred embodiment of the present invention, there is provided an an electrophotographic photoreceptor including: an intermediate layer; a photosensitive layer; and a surface protective layer, deposited in this order on an electroconductive support, wherein the surface protective layer includes a resin and a p-type semiconductor microparticle contained in the resin; and the intermediate layer includes a resin and at least one metal oxide microparticle contained in the resin, wherein the at least one metal oxide microparticle is selected from the group consisting of untreated tin oxide particles, tin oxide particles surface-treated with organic compounds, untreated anatase titanium oxide particles, anatase titanium oxide particles surface-treated with organic compounds, untreated rutile titanium oxide particles, and rutile titanium oxide particles surface-treated with organic compounds.

Preferably, the resin constituting the surface protective layer is a cured resin prepared by polymerization of a crosslinkable polymerizable compound.

Preferably, the p-type semiconductor microparticle is made of a compound represented by Formula (1) or Formula (2):

$$CuM^1O_2 \qquad \text{Formula (1):}$$

where $M^1$ represents an element belonging to Group 13 on the periodic table, $$M^2Cu_2O_2 \qquad \text{Formula (2):}$$

where $M^2$ represents an element belonging to Group 2 on the periodic table.

Preferably, the p-type semiconductor microparticle is a particle surface-treated with a surface treating agent having a reactive organic group.

Preferably, the crosslinkable polymerizable compound is a polymerizable monomer at least having an acryloyl group or a methacryloyl group.

Preferably, the metal oxide microparticle contained in the intermediate layer is a particle surface-treated with an inorganic oxide and further with an organic compound.

According to a second aspect of a preferred embodiment of the present invention, there is provided an electrophotographic image forming apparatus including the electrophotographic photoreceptor according to the first aspect of the present invention According to a third aspect of a preferred embodiment of the present invention, there is provided an electrophotographic image forming process including use of the electrophotographic photoreceptor according to the first aspect of the present invention.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

The present invention will now be specifically described.

[Photoreceptor]

The electrophotographic photoreceptor of the present invention is an organic photoreceptor including an intermediate layer, a photosensitive layer, and a surface protective layer deposited in this order on an electroconductive support.

In the present invention, the organic photoreceptor has a configuration exhibiting at least one of a charge-generating function and a charge-transporting function, which are indispensable for the photoreceptor formation, by an organic compound, and the term "organic photoreceptor" encompasses all known organic photoreceptors, such as a photoreceptor including an organic photosensitive layer composed of a known organic charge-generating material or organic charge-transporting material and a photoreceptor including an organic photosensitive layer composed of a polymer complex exhibiting a charge-generating function and a charge-transporting function.

Figure 1:
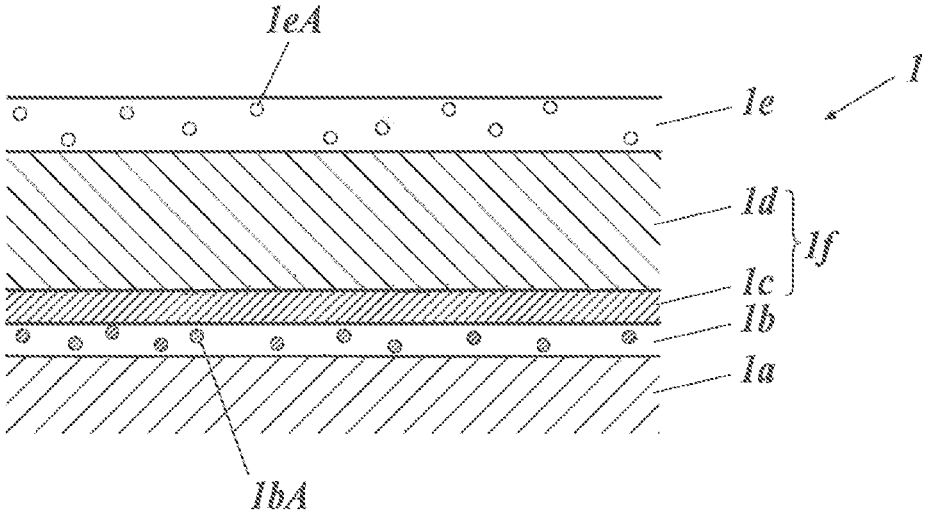
FIG. 1 is a partial cross-sectional view illustrating an example layer configuration of the electrophotographic photoreceptor of the present invention.

In the photoreceptor, for example, as shown in FIG. 1, an intermediate layer 1*b*, a charge-generating layer 1*c*, a charge-transporting layer 1*d*, and a surface protective layer 1*e* are deposited in this order on an electroconductive support 1*a* to form a photoreceptor 1. The charge-generating layer 1*c* and the charge-transporting layer 1*d* constitute an organic photosensitive layer 1*f*, which is indispensable for the organic photoreceptor formation. The intermediate layer 1*b* contains a metal oxide microparticle 1*b*A. The surface protective layer 1*e* contains a p-type semiconductor microparticle 1*e*A.

[Electroconductive Support 1*a*]

The electroconductive support may be composed of any electroconductive material. Examples of such a material include drum- or sheet-shaped metals such as aluminum, copper, chromium, nickel, zinc, and stainless steel; plastic films laminated with metal foil, such as aluminum or copper foil; plastic films provided with, for example, deposited aluminum, indium oxide, or tin oxide thereon; and metals, plastic films, and paper provided with electroconductive layers by application of an electroconductive material alone or together with a binder resin.

[Intermediate Layer 1*b*]

The intermediate layer constituting the photoreceptor of the present invention is made of, for example, a binder resin (hereinafter, also referred to as "binder resin for an intermediate layer") containing a metal oxide microparticle 1*b*A.

The intermediate layer provides a barrier function and an adhesive function between the electroconductive support and the organic photosensitive layer.

Examples of the binder resin for an intermediate layer include polyamide resins, vinyl chloride resins, vinyl acetate resins, casein, poly(vinyl alcohol) resins, polyurethane resins, nitrocellulose, ethylene-acrylic acid copolymers, and gelatin. Among these binder resins, polyamide resins are preferred from the viewpoint of preventing the binder resin for an intermediate layer from being dissolved in a coating solution for forming a charge-generating layer (described below) during the application of the coating solution onto the intermediate layer. In addition, since the metal oxide microparticles surface-treated with an organic compound can be suitably dispersed in alcohols, alcohol-soluble polyamide resins, such as methoxymethylol polyamide resins, are more preferred.

[Metal Oxide Microparticle 1*b*A]

The intermediate layer contains at least one metal oxide microparticle selected from untreated tin oxide particles, tin oxide particles surface-treated with organic compounds (hereinafter, also expressed as "organic-treated"), untreated anatase titanium oxide particles, organic-treated anatase titanium oxide particles, untreated rutile titanium oxide particles, and organic-treated rutile titanium oxide particles. Hereinafter, these microparticles are referred to as "specific metal oxide microparticles" and may be used alone or in combination.

In the present invention, "surface treatment with an organic compound" refers to surface treatment of untreated microparticles with an organic compound only and also refers to surface treatment of untreated microparticles with an inorganic surface-treating agent, such as an inorganic oxide, and then with an organic compound.

Among the specific metal oxide microparticles, organic-treated tin oxide, anatase titanium oxide, and rutile titanium oxide microparticles are preferably surface-treated with inorganic oxides (hereinafter, also expressed as "inorganic-treated") before the organic treatment.

Examples of the organic compound used in the surface treatment (hereinafter, also referred to as "organic surface treating agent") include alkoxysilanes represented by Formula (a); organic silicon compounds, such as methyl hydrogen polysiloxane; and organic titanium compounds.

$$R^1\text{—Si—}(X)_3 \qquad \text{Formula (a):}$$

where $R^1$ represents an alkyl group having 1 to 10 carbon atoms and containing a methacryloxy group or an acryloxy group; and X represents an alkoxy group having 1 to 4 carbon atoms.

The alkoxysilanes represented by Formula (a) are more specifically, for example, 3-methacryloxypropyltrimethoxysilane, 3-methacryloxypropyltriethoxysilane, 3-acryloxypropyltrimethoxysilane, 3-acryloxypropyltriethoxysilane, 2-methacryloxyethyltrimethoxysilane, and 3-methacryloxybutyltrimethoxysilane. In particular, 3-methacryloxypropyltrimethoxysilane and 3-acryloxypropyltrimethoxysilane are preferred, and 3-methacryloxypropyltrimethoxysilane is most preferred. These alkoxysilanes may be used alone or in combination.

The methyl hydrogen polysiloxane includes a structural unit, methyl hydrogen siloxane unit: —(HSi($CH_3$)O)—, and preferably a copolymer with another siloxane unit. Examples of the siloxane unit forming the copolymer with the methyl hydrogen siloxane unit include dimethylsiloxane, methylethylsiloxane, methylphenylsiloxane, and diethylsiloxane units. These units may be used in combination. A methyl hydrogen polysiloxane having a molecular weight of 1000 to 20000 is preferred because of its high surface treatment effect.

Examples of the organic titanium compound include alkoxytitanium, titanium polymers, titanium acylates, titanium chelates, tetrabutyl titanate, tetraoctyl titanate, isopropyl triisostearoyl titanate, isopropyltridecylbenzenesulfonyl titanate, and bis (dioctylpyrophosphate)oxyacetate titanate.

The metal oxide microparticles may be surface-treated with an organic surface treating agent by any known method, and wet or dry surface treatment can be employed.

In the dry surface treatment, the microparticles to be treated are dispersed into a cloudy dispersion by, for example, stirring; and a solution for surface treatment prepared by dissolving an organic surface treating agent in a solvent is sprayed or vaporized so that the organic surface treating agent is brought into contact with the microparticles and is allowed to adhere to the microparticles. In the wet surface treatment, for example, the microparticles to be treated are added to a solution for surface treatment prepared by dissolving or dispersing the organic surface treating agent in an organic solvent, and the mixture is mixed by stirring. Alternatively, the organic surface treating agent is dropwise added to a dispersion prepared by dispersing the microparticles in a solution for surface treatment. The microparticles to which the organic surface treating agent adhere are subjected to wet disintegration treatment with a bead mill or another tool. The solvent is then removed from the resulting dispersion by, for example, distillation under reduced pressure, and the resulting microparticles are subjected to annealing (baking). Among these surface treatment procedures, preferred is wet surface treatment, which is a simple process.

The solvent for preparing the solution for surface treatment is preferably an organic solvent. Examples of the organic solvent include aromatic hydrocarbon solvents, such as benzene, toluene, and xylene; and ether solvents, such as tetrahydrofuran and dioxane.

The mixing and stirring in the wet surface treatment may be appropriately performed until the microparticles to be treated are sufficiently dispersed. The temperature for the wet disintegration is preferably about 15° C. to 100° C., and more preferably 20° C. to 50° C. The time for the disintegration is preferably 0.5 to 10 hours, and more preferably 1 to 5 hours. The baking temperature for the annealing can be, for example, 100° C. to 220° C., and preferably 110° C. to 150° C. The time for the baking is preferably 0.5 to 10 hours, and more preferably 1 to 5 hours. These conditions are merely examples and may vary depending on the treatment apparatus. The actual treatment may be performed outside the above-mentioned ranges.

The amount of the organic surface treating agent used in the wet surface treatment varies depending on the type for the agent and can be, for example, 0.1 to 20 parts by mass, more preferably 1 to 15 parts by mass, based on 100 parts by mass of the microparticles to be treated. The amount of the solvent can be 100 to 600 parts by mass, more preferably 200 to 500 parts by mass, based on 100 parts by mass of the microparticles to be treated.

The organic surface treating agent in an amount that is not lower than the lower limit can achieve sufficient surface-treatment of the microparticles and can therefore provide an appropriate electron transportability to the intermediate layer. The organic surface treating agent in an amount that is not higher than the upper limit can prevent the intermolecular reaction of the organic surface treating agent and can therefore prevent leakage due to failure in attachment of uniform coating films onto the surfaces of the microparticles.

Whether the metal oxide microparticles contained in the intermediate layer are surface-treated can be confirmed by verification of the manufacturing process or inorganic analysis of the surfaces of the metal oxide microparticles contained in the intermediate layer by transmission electron microscopy and energy-dispersive X-ray analysis (TEM-EDX) or wavelength-dispersive fluorescent X-ray analysis (WDX).

Among the specific metal oxide microparticles, the organic-treated tin oxide particles, anatase titanium oxide particles, and rutile titanium oxide particles are preferably inorganic-treated prior to the organic treatment.

Examples of the inorganic oxide used for surface treatment (hereinafter, also referred to as "inorganic surface treating agent") include alumina, silica, and zirconia and hydrates thereof. These inorganic oxides may be used alone or in combination. In particular, preferred are sole use of alumina or silica and combination use of alumina and silica.

The surface treatment of metal oxide microparticles covers the active hydroxy groups on the surfaces of the metal oxide microparticles to eliminate unnecessary activity. In particular, the active hydroxy groups on a surface can be more certainly covered by performing both inorganic treatment and organic treatment, resulting in a large reduction in unnecessary activity.

The surface treatment with an inorganic surface treating agent can be performed as follows: Microparticles to be treated are dispersed in a solvent, such as water, followed by stirring and suspending. The dispersion may have any concentration that allows surface treatment of the entire surfaces of the particles, and the concentration of the microparticles to be treated is preferably 0.1% to 20% by mass. The pH of this suspension is preferably adjusted to 8.0 or more with, for example, sodium hydroxide. Subsequently, a precursor solution, such as a silicate solution in silica treatment or an aluminic acid solution in alumina treatment, is added to the dispersion, and the solution is preferably heated to 60° C. to 100° C. The amount of the inorganic surface treating agent is preferably 1% to 20% by mass based on the amount of the microparticles to be treated. Subsequently, an acid is dropwise added to the solution over 0.5 to 5 hours into an acidic pH. The resulting microparticles are filtered, washed, and dried.

The inorganic-treated metal oxide microparticles may be commercial products, such as titanium oxide particles treated with silica or alumina. Examples of the commercial products include "T-805" (manufactured by Nippon Aerosil Co., Ltd.); "STT-30A" and "STT-65S-S" (manufactured by Titan Kogyo, Ltd.); "TAF-500T" and "TAF-1500T" (manufactured by Fuji Titanium Industry Co., Ltd.); "MT-100S", "MT-100T", "MT-100SA", and "MT-500SA" (manufactured by Tayca Corporation); and "IT-S" (manufactured by Ishihara Sangyo Kaisha, Ltd.).

These specific metal oxide microparticles preferably have a number-average primary particle diameter of 5 to 100 nm, more preferably 10 to 50 nm, for example.

The specific metal oxide microparticles having a number-average primary particle diameter in the range mentioned above can provide suitable electron transportability without decreasing the dispersibility.

The number-average primary particle diameter of the specific metal oxide microparticles is measured as follows: 100 particles are selected at random, as primary particles, from a transmission electron microscopic (TEM) image (×100000) of the specific metal oxide microparticles. The average Feret's diameter of the primary particles is measured by image analysis as the "number-average primary particle diameter".

The content of the specific metal oxide microparticles is preferably 200 to 600 parts by mass, more preferably 200 to 500 parts by mass, based on 100 parts by mass of the binder resin for an intermediate layer. Control of the components of the intermediate layer by volume ratios is also effective for more certainly achieving the above-described advantageous effects. That is, the volume ratio, (the total of the specific metal oxide microparticles):(binder resin), is preferably 5:10 to 11:10.

The intermediate layer can be certainly provided with electron transportability by controlling the content of the specific metal oxide microparticles to 200 parts by mass or more based on 100 parts by mass of the binder resin for an intermediate layer. In addition, a content of the specific metal oxide microparticles of 600 parts by mass or less based on 100 parts by mass of the binder resin for an intermediate layer leads to formation of a coating film for the intermediate layer without obstruction by the microparticles.

The intermediate layer may contain another metal oxide microparticle in addition to the above-mentioned specific metal oxide microparticles. Such additional metal oxide microparticle may be any particle, and examples thereof include microparticles of metal oxides, such as zinc oxide, alumina (aluminum oxide), silica (silicon oxide), tin oxide, antimony oxide, indium oxide, bismuth oxide, magnesium oxide, lead oxide, tantalum oxide, yttrium oxide, cobalt oxide, copper oxide, manganese oxide, selenium oxide, iron oxide, zirconium oxide, germanium oxide, niobium oxide, molybdenum oxide, and vanadium oxide; microparticles of indium oxide doped with tin; and microparticles of tin oxide or zirconium oxide doped with antimony. These microparticles may be used alone or in combination.

[Formation of Intermediate Layer]

The intermediate layer can be formed, for example, as follows: A binder resin for an intermediate layer is dissolved or dispersed in a solvent. Specific metal oxide microparticles are then uniformly dispersed therein to prepare a dispersion. This dispersion is left to stand and is then filtered to prepare a coating solution for forming an intermediate layer. The coating solution for forming an intermediate layer is applied to the surface of the electroconductive support to form a coating film, and this coating film is dried into an intermediate layer.

The solvent used in formation of the intermediate layer may be any solvent that can dissolve the binder resin for an intermediate layer and can well disperse the specific metal oxide microparticles. For example, in the case of using a polyamide resin as the binder resin for an intermediate layer, since alcohols can express good dissolution and application ability for polyamide resins, alcohols, such as methanol, ethanol, n-propyl alcohol, isopropyl alcohol, n-butanol, t-butanol, and sec-butanol, can be preferably used. These solvents may be used alone or in combination.

In addition, in order to improve the storage stability and the dispersibility of specific metal oxide microparticles, a co-solvent may also be used. Examples of the co-solvent include benzyl alcohol, toluene, cyclohexanone, and tetrahydrofuran.

The specific metal oxide microparticles can be dispersed with an ultrasonic disperser, bead mill, ball mill, sand grinder, homomixer, or another tool.

The concentration of the binder resin for an intermediate layer in the coating solution for forming an intermediate layer varies depending on the thickness of the intermediate layer and the method of application. For example, the amount of the solvent is preferably 100 to 3000 parts by mass, more preferably 500 to 2000 parts by mass, based on 100 parts by mass of the binder resin for an intermediate layer.

The coating solution for forming an intermediate layer may be applied by any method and can be applied by, for example, dipping application or spray coating.

The coating film may be dried by a known drying method appropriately selected depending on the type of the solvent and the thickness of the intermediate layer to be formed. In particular, thermal drying is preferred. The drying conditions are, for example, for 10 to 60 min at 100° C. to 150° C.

The intermediate layer preferably has a thickness of 0.5 to 15 μm and more preferably 1 to 7 μm.

A too small thickness of the intermediate layer cannot cover the entire surface of the electroconductive support and cannot sufficiently block the injection of holes from the electroconductive support, resulting in a risk of insufficient prevention of image defects, such as black points and fogging. In contrast, a too large thickness of the intermediate layer increases the electrical resistance to give insufficient electron transportability, resulting in a risk of insufficient prevention of occurrence of uneven density.

[Charge-Generating Layer 1*c*]

The charge-generating layer is composed of a charge-generating material and a binder resin (hereinafter, also referred to as "binder resin for a charge-generating layer").

Examples of the charge-generating material include, but not limited to, azo materials, such as Sudan Red and Dian Blue; quinone pigments, such as pyrene quinone and anthanthrone; quinocyanine pigments; perylene pigments; indigo pigments, such as indigo and thioindigo; polycyclic quinone pigments, such as pyranthrone and diphthaloylpyrene; and phthalocyanine pigments. Among these materials, preferred are polycyclic quinone pigments and titanyl phthalocyanine pigments. These charge-generating materials may be used alone or in combination.

The binder resin for a charge-generating layer may be a known resin. Examples of the resin include, but not limited to, polystyrene resins, polyethylene resins, polypropylene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, and melamine resins; copolymer resins containing two or more of these resins (e.g., vinyl chloride-vinyl acetate copolymer resins, vinyl chloride-vinyl acetate-maleic anhydride copolymer resins); and polyvinyl carbazole resins. Among these resins, preferred are polyvinyl butyral resins.

The amount of the charge-generating material in the charge-generating layer is preferably 1 to 600 parts by mass, more preferably 50 to 500 parts by mass, based on 100 parts by mass of the binder resin for a charge-generating layer.

The amount of the charge-generating material is preferably 20 to 600 parts by mass, more preferably 50 to 500 parts by mass, based on 100 parts by mass of the resin for charge-generating layer. In this range of the ratio of the charge-generating material to the binder resin for a charge-generating layer, the coating solution for forming a charge-generating layer (described below) can have high dispersion stability, and the resulting photoreceptor has reduced electrical resistance and can notably prevent an increase of residual potential associated with repeated use.

The charge-generating layer can be formed as follows. For example, a charge-generating material is added to and dispersed in a binder resin for a charge-generating layer dissolved in a known solvent to prepare a coating solution for forming a charge-generating layer. This coating solution for forming a charge-generating layer is applied to the surface of the intermediate layer to form a coating film. This coating film is dried into a charge-generating layer.

The solvent used in formation of the charge-generating layer may be any solvent that can dissolve the binder resin for a charge-generating layer. Typical examples of the solvent can be mentioned and include, but not limited to, ketone solvents, such as methyl ethyl ketone, methyl isopropyl ketone, methyl isobutyl ketone, cyclohexanone, and acetophenone; ether solvents, such as tetrahydrofuran, dioxolane, and diglyme; alcohols, such as methylcellosolve, ethylcellosolve, and butanol; ester solvents, such as ethyl acetate and t-butyl acetate; aromatic solvents, such as toluene and chlorobenzene; and halogen solvents, such as dichloroethane and trichloroethane. These solvents may be used alone or in combination.

Examples of the method of dispersion of the charge-generating material are the same as those mentioned as the methods of dispersion of the specific metal oxide microparticles in the coating solution for forming an intermediate layer.

Examples of the method of application of the coating solution for forming a charge-generating layer are the same as those mentioned as the methods of application of the coating solution for forming an intermediate layer.

The thickness of the charge-generating layer varies depending on, for example, the characteristics and contents of the charge-generating material and the binder resin for the charge-generating layer, and is preferably 0.1 to 2 μm and more preferably 0.15 to 1.5 μm.

[Charge-Transporting Layer 1*d*]

The charge-transporting layer is composed of a charge-transporting material and a binder resin (hereinafter, also referred to as "binder resin for a charge-transporting layer").

The charge-transporting material of the charge-transporting layer transports charge, and examples such a material include triphenylamine derivatives, hydrazone compounds, styryl compounds, benzidine compounds, and butadiene compounds.

The binder resin for a charge-transporting layer may be a known resin. Examples of the resin include polycarbonate resins, polyacrylate resins, polyester resins, polystyrene resins, styrene-acrylonitrile copolymer resins, polymethacrylic acid ester resins, and styrene-methacrylic acid ester copolymer resins. Preferred are polycarbonate resins. Further preferred are, for example, bisphenol A (BPA), bisphenol Z (BPZ), dimethyl BPA, and BPA-dimethyl BPA copolymer polycarbonate resins, from the points of view of crack resistance, wear resistance, and chargeability.

The amount of the charge-transporting material in the charge-transporting layer is preferably 10 to 500 parts by mass, more preferably 20 to 250 parts by mass, based on 100 parts by mass of the binder resin for a charge-transporting layer.

The charge-transporting layer may contain an antioxidant, an electronic conductive agent, a stabilizer, a silicone oil, and other agents. Preferred examples of the antioxidant are those described in Japanese Patent Laid-Open No. 2000-305291. Preferred examples of the electronic conductive agent are those described in Japanese Patent Laid-Open Nos. S50-137543 and S58-76483.

The thickness of the charge-transporting layer varies in the range of preferably 5 to 40 μm, more preferably 10 to 30 μm, although it depends on, for example, the characteristics of the charge-transporting material and the binder resin for a charge-transporting layer and the mixing ratio thereof.

The charge-transporting layer can be formed as follows. For example, a charge-transporting material (CTM) is dispersed in a binder resin for a charge-transporting layer dissolved in a known solvent to prepare a coating solution for forming a charge-transporting layer. This coating solution for forming a charge-transporting layer is applied to the surface of the charge-generating layer to form a coating film. This coating film is dried into a charge-transporting layer.

Examples of the solvent used in formation of the charge-transporting layer includes the same solvents as those mentioned as the solvents used in formation of the charge-generating layer.

Examples of the method of application of the coating solution for forming a charge-transporting layer are the same as those mentioned as the methods of application of the coating solution for forming an intermediate layer.

[Surface Protective Layer 1*e*]

The surface protective layer constituting the photoreceptor of the present invention is made of a binder resin (hereinafter, also referred to as "binder resin for a surface protective layer") containing a p-type semiconductor microparticle 1*e*A.

[p-Type Semiconductor Microparticle 1*e*A]

The charge carrier of p-type semiconductor microparticles is a hole. The p-type semiconductor microparticles contribute to the stability of image quality.

In the present invention, the p-type semiconductor microparticle is preferably a metal oxide microparticle, in particular, a microparticle made of a compound represented by Formula (1) or Formula (2):

$$CuM^1O_2 \qquad \text{Formula (1):}$$

where $M^1$ represents an element belonging to Group 13 on the periodic table;

$$M^2Cu_2O_2 \qquad \text{Formula (2):}$$

where $M^2$ represents an element belonging to Group 2 on the periodic table.

Examples of the element belonging to Group 13 on the periodic table include boron (B), aluminum (Al), gallium (Ga), indium (In), and thallium (Tl). In the present invention, aluminum, gallium, and indium are preferred.

In the present invention, preferred examples of the compound represented by Formula (1) include $CuAlO_2$, $CuGaO_2$, and $CuInO_2$.

Examples of the element belonging to Group 2 on the periodic table include beryllium (Be), magnesium (Mg), calcium (Ca), strontium (Sr), barium (Ba), and radium (Ra). In the present invention, barium and strontium are preferred.

In the present invention, preferred examples of the compound represented by Formula (2) include $SrCu_2O_2$, $MgCu_2O_2$, $BaCu_2O_2$, and $CaCu_2O_2$.

The p-type semiconductor microparticles preferably have a number-average primary particle diameter of 1 to 300 nm and more preferably 3 to 100 nm.

The number-average primary particle diameter of p-type semiconductor microparticles can be determined by photographing the microparticles with a scanning electron microscope "JSM-7500F" (manufactured by JEOL Ltd.) at a magnification of 100000, capturing a photographic image from the photograph with a scanner, binarizing 100 p-type semiconductor microparticles (excluding agglomerates) selected at random with an automatic image processing analyzer "LUZEX AP (software: Ver.1.32)" (manufactured by Nireco Corporation), calculating the horizontal Feret's diameter of each p-type semiconductor microparticle, and calculating the average of the diameters as the number-average primary particle diameter. The term "horizontal Feret's diameter" refers to the length of a side, parallel to the x-axis, of a bounding rectangle when an image of a p-type semiconductor microparticle is binarized.

The p-type semiconductor microparticles can be produced by, for example, a sintering process. For example, in production of $CuAlO_2$ p-type semiconductor microparticles, $Al_2O_3$ (purity: 99.9%) and $Cu_2O$ (purity: 99.9%) are mixed at a molar ratio of 1:1; the mixture is calcined in an Ar atmosphere at 1100° C. for 4 days and is then molded into a pellet; and the pellet is sintered at 1100° C. for 2 days to give a sintered compact. Subsequently, the sintered compact is roughly pulverized into several hundred micrometers, and the resulting coarse particles are mixed with a solvent and are finely pulverized with a wet-media dispersion apparatus to give $CuAlO_2$ particles having a desired particle diameter.

Alternatively, the p-type semiconductor microparticles can be produced by, for example, a plasma process, such as a direct-current plasma arc process, a high-frequency plasma process, or a plasma jet process.

In the direct-current plasma arc process, a metal alloy is used as a consumptive anode electrode; plasma flame from a cathode electrode heats and evaporates the metal alloy of the anode electrode; and the vapor of the metal alloy is oxidized and cooled into p-type semiconductor microparticles.

The high-frequency plasma process utilizes thermal plasma that is generated by heating a gas through high-frequency inductive discharge under an atmospheric pressure. In a plasma evaporation process, solid particles are placed into the center of an inert gas plasma and are evaporated while passing through the plasma. This high-temperature vapor is quenched to be condensed into p-type semiconductor microparticles.

In the plasma process, arc discharge is performed in an atmosphere of an inert argon gas or a diatomic molecule gas, such as hydrogen, nitrogen, or oxygen, to give argon plasma or hydrogen (nitrogen or oxygen) plasma. The hydrogen (nitrogen or oxygen) plasma is highly reactive compared to inert gas plasma and is also referred to as reactive arc plasma to distinguish from inert gas plasma.

The p-type semiconductor microparticles can be preferably produced by the plasma process using oxygen plasma as the reactive arc plasma.

The amount of the p-type semiconductor microparticles is preferably 20 to 300 parts by mass, more preferably 50 to 200 parts by mass, based on 100 parts by mass of the binder resin for a surface protective layer.

The surface protective layer can be certainly provided with charge transportability by controlling the content of the p-type semiconductor microparticles to 20 parts by mass or more based on 100 parts by mass of the binder resin for a surface protective layer. In addition, a content of the p-type semiconductor microparticles of 300 parts by mass or less based on 100 parts by mass of the binder resin for a surface protective layer can certainly prevent fogging and also can form a coating film for the surface protective layer without obstruction by the microparticles.

[Surface-Treated p-Type Semiconductor Microparticle]

The p-type semiconductor microparticles contained in the surface protective layer are preferably surface-treated with a surface treating agent, from the viewpoint of providing dispersibility and improving the wear resistance, and more preferably surface-treated with a surface treating agent having a reactive organic group, from the viewpoint of binding with the binder resin for a surface protective layer.

The surface treating agent preferably reacts with the hydroxy or any other group present on the surface of the untreated p-type semiconductor microparticles. Examples of such a surface treating agent include silane coupling agents and titanium coupling agents.

In the present invention, a surface treating agent having a reactive organic group, in particular, a radical polymerizable reactive group, is preferably used in order to further increase the hardness of the surface protective layer. When the binder resin for a surface protective layer is the cured resin of a polymerizable compound shown below, the surface treating agent having a radical polymerizable reactive group also reacts with the polymerizable compound, resulting in formation of a strong surface protective layer.

The surface treating agent having a radical polymerizable reactive group is preferably a silane coupling agent having an acryloyl group or a methacryloyl group. The surface treating agents having such radical polymerizable reactive groups include the following known compounds.

Examples of the silane coupling agent having an acryloyl group or a methacryloyl group include the following compounds.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2\ (OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

In addition to the silane coupling agents S-1 to S-36, examples of the surface treating agent include silane compounds having reactive organic groups that can participate in radical polymerization. These surface treating agents can be used alone or in combination.

The surface treating agent may be used in any amount. The amount is preferably 0.1 to 100 parts by mass based on 100 parts by mass of the untreated p-type semiconductor microparticles.

[Surface Treatment of p-Type Semiconductor Microparticles]

Specifically, the surface treatment of the p-type semiconductor microparticles is performed as follows. A slurry (suspension of solid particles) containing untreated p-type semiconductor microparticles and a surface treating agent is wet-pulverized for refinement of the p-type semiconductor microparticles and progress of surface treatment of the microparticles. The solvent is then removed, followed by pulverization.

The slurry is preferably a mixture containing 0.1 to 100 parts by mass of a surface treating agent and 50 to 5000 parts by mass of a solvent, based on 100 parts by mass of untreated p-type semiconductor microparticles.

An example of the apparatus for the wet-pulverization of the slurry is a wet-media dispersion apparatus.

The wet-media dispersion apparatus has a vessel containing beads as media and pulverizes agglomerated p-type semiconductor microparticles and disperses the pulverized microparticles by high-rate rotation of a stirring disk orthogonally attached to the rotating shaft. The apparatus may have any structure that can sufficiently disperse the p-type semiconductor microparticles and can perform surface treatment. Various modes, for example, a vertical or horizontal type and a continuous or batch process, can be employed. Specifically, a sand mill, an Ultra Visco mill, a pearl mill, a grain mill, a dyno mill, an agitator mill, or a dynamic mill can be used. These dispersion apparatuses conduct fine pulverization and dispersion by, for example, impact crush, friction, shear, or shearing stress with grinding media, such as balls and beads.

The beads for the wet-media dispersion apparatus can be balls made of glass, alumina, zircon, zirconia, steel, or flint stone, and preferred are zirconia or zircon beads. Although the beads usually have a diameter of approximately 1 to 2 mm, the diameter is preferably approximately 0.1 to 1.0 mm in the present invention.

The disk and the inner wall of the vessel of the wet-media dispersion apparatus may be made of various materials, such as stainless steel, nylons, and ceramics. In the present invention, the disk and the inner wall of the vessel are preferably made of ceramics, such as zirconia or silicon carbide.

[Binder Resin for Surface Protective Layer]

The binder resin for a surface protective layer is preferably a thermoplastic resin or a photocurable resin and is more preferably a photocurable resin because of its provision of high film strength.

Usable examples of the binder resin for a surface protective layer include polyvinyl butyral resins, epoxy resins, polyurethane resins, phenol resins, polyester resins, alkyd resins, polycarbonate resins, silicone resins, acrylic resins, and melamine resins. Preferred thermoplastic resins are polycarbonate resins. Preferred photocurable resins are prepared by polymerization of crosslinkable polymerizable compounds, specifically, compounds having two or more radical polymerizable functional groups (hereinafter, also referred to as "polyfunctional radical polymerizable compounds") by irradiation with active energy rays, such as ultraviolet rays and electron beams.

The above-mentioned binder resins for a surface protective layer can be used alone or in combination.

[Polyfunctional Radical Polymerizable Compound]

The polyfunctional radical polymerizable compound is preferably an acrylic monomer having two or more acryloyl groups ($CH_2{=}CHCO{-}$) or methacryloyl groups ($CH_2{=}CCH_3CO{-}$) as the radical polymerizable functional groups or an oligomer thereof, because of their curability with a low light intensity or a short irradiation time. Accordingly, the cured resin is preferably an acrylic resin formed from an acrylic monomer or its oligomer.

Examples of the polyfunctional radical polymerizable compound include the following compounds.

[Chem. 1]

M1

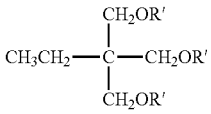

M2

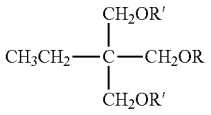

M3

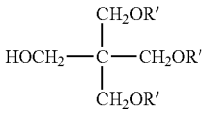

M4

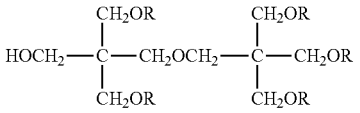

-continued

M5

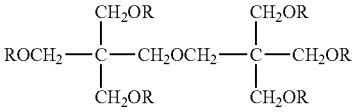

M6

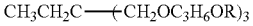

M7

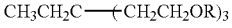

[Chem. 2]

M8

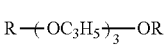

M9

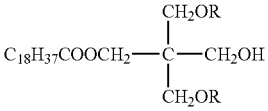

M10

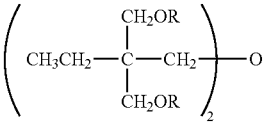

M11

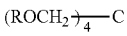

M12

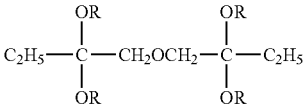

M13

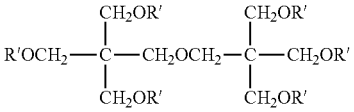

M14

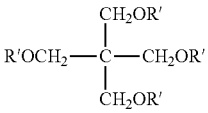

M15

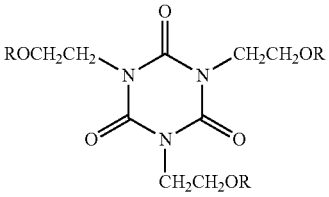

In the chemical formulae representing example compounds M1 to M15, R represents an acryloyl group ($CH_2{=}CHCO{-}$); and R' represents a methacryloyl group ($CH_2{=}CCH_3CO{-}$).

The surface protective layer optionally contains lubricant particles and various types of antioxidants, in addition to the binder resin for a surface protective layer and the p-type semiconductor microparticles.

[Lubricant Particles]

The lubricant particles can be, for example, fluorine-containing resin particles. Examples of the fluorine-containing resin particles include particles of ethylene tetrafluoride resins, ethylene trifluoride chloride resins, ethylene propylene hexafluoride chloride resins, vinyl fluoride resins, vinylidene fluoride resins, and ethylene difluoride dichloride resins. These copolymers can be used alone or in combination. Among these resins, in particular, preferred are ethylene tetrafluoride resins and vinylidene fluoride resins.

The surface protective layer preferably has a thickness of 0.2 to 10 μm and more preferably 0.5 to 6 μm.

[Formation of Surface Protective Layer]

The surface protective layer can be produced as follows. A polyfunctional radical polymerizable compound, p-type semiconductor microparticles, and optional other components, such as a known resin, a polymerization initiator, lubricant particles, and an antioxidant, are added to a solvent to prepare a coating solution. The coating solution is applied onto the surface of the charge-transporting layer by a known method to form a coating film. The coating film is cured into a surface protective layer.

[Polymerization Initiator]

The polymerization initiator that can be contained in the surface protective layer is a radical polymerization initiator, such as a thermal polymerization initiator or a photopolymerization initiator, which initiates polymerization of the polyfunctional radical polymerizable compound.

The polyfunctional radical polymerizable compound can be polymerized through a cleavage reaction by electron beam irradiation or polymerization by irradiation with light or heat in the presence of a radical polymerization initiator.

Examples of the thermal polymerization initiator include azo compounds, such as 2,2'-azobisisobutyronitrile, 2,2'-azobis(2,4-dimethylazobisvaleronitrile), and 2,2'-azobis(2-methylbutyronitrile); and peroxides, such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, and lauroyl peroxide.

Examples of the photopolymerization initiator include acetophenone or ketal photopolymerization initiators, such as diethoxyacetophenone, 2,2-dimethoxy-1,2-diphenylethan-1-one, 1-hydroxy-cyclohexyl-phenylketone, 4-(2-hydroxyethoxy)phenyl-(2-hydroxy-2-propyl)ketone, 2-benzyl-2-dimethylamino-1-(4-morpholinophenyl)butanone-1 (Irgacure 369: manufactured by BASF Japan Ltd.), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime; benzoin ether photopolymerization initiators, such as benzoin, benzoin methyl ether, benzoin ethyl ether, benzoin isobutyl ether, and benzoin isopropyl ether; benzophenone photopolymerization initiators, such as benzophenone, 4-hydroxybenzophenone, methyl o-benzoylbenzoate, 2-benzoylnaphthalene, 4-benzoylbiphenyl, bis(4-benzoylphenyl) ether, acrylated benzophenone, and 1,4-benzoylbenzene; and thioxanthone photopolymerization initiators, such as 2-isopropylthioxanthone, 2-chlorothioxanthone, 2,4-dimethylthioxanthone, 2,4-diethylthioxanthone, and 2,4-dichlorothioxanthone.

Other examples of the photopolymerization initiator include ethylanthraquinone, 2,4,6-trimethylbenzoyl diphenylphosphine oxide, 2,4,6-trimethylbenzoyl phenylethoxyphosphine oxide, bis(2,4,6-trimethylbenzoyl)phenylphosphine oxide (Irgacure 819: manufactured by BASF Japan Ltd.), bis(2,4-dimethoxybenzoyl)-2,4,4-trimethylpentylphosphine oxide, methylphenylglyoxy ester, 9,10-phenanthrene, acridine compounds, triazine compounds, and imidazole compounds. Alternatively, compounds having an effect of accelerating photopolymerization may be used alone or in combination with the above-mentioned photopolymerization initiator. Examples of the compound accelerating photopolymerization include triethanolamine, methyldiethanolamine, ethyl 4-dimethylaminobenzoate, isoamyl 4-dimethylaminobenzoate, benzoic acid 2-(dimethylamino) ethyl ester, and 4,4'-dimethylaminobenzophenone.

The polymerization initiator is preferably a photopolymerization initiator, more preferably an alkylphenone compound or a phosphine oxide compound, and most preferably a photopolymerization initiator having an α-hydroxyacetophenone structure or an acylphosphine oxide structure.

These polymerization initiators may be used alone or in combination.

The amount of the polymerization initiator is 0.1 to 40 parts by mass, preferably 0.5 to 20 parts by mass, based on 100 parts by mass of the polyfunctional radical polymerizable compound.

[Solvent]

Examples of the solvent used for formation of the surface protective layer include, but not limited to, methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, and diethylamine.

These solvents may be used alone or in combination.

Curing treatment is preferably performed by irradiating the coating film with active energy rays to generate radicals and to cause polymerization and forming crosslinking bonds through intermolecular and intramolecular crosslinking reaction to generate a binder resin for a surface protective layer. The active energy rays are preferably ultraviolet rays, light such as visible light, or electron beams. Ultraviolet rays are most preferred because of its ease of use.

The ultraviolet ray source that can be used is, for example, a low-pressure mercury lamp, medium-pressure mercury lamp, high-pressure mercury lamp, ultrahigh-pressure mercury lamp, carbon arc lamp, metal halide lamp, xenon lamp, flash (pulse) xenon lamp, or ultraviolet LED lamp. The irradiation conditions vary depending on the lamp used. The dose of the active energy rays is usually 1 to 20 $mJ/cm^2$ and preferably 5 to 15 $mJ/cm^2$. The output voltage of the light source is preferably 0.1 to 5 kW and more preferably 0.5 to 3 kW.

The electron beam source that can be preferably used is, for example, an electron beam irradiator of a curtain beam system. The accelerating voltage in electron beam irradiation is preferably 100 to 300 kV. The absorbed dose is preferably 0.005 Gy to 100 kGy (0.5 to 10 Mrad).

The irradiation time required for achievement of a dose of active energy rays is preferably 0.1 sec to 10 min and more preferably 1 sec to 5 min from the viewpoint of curing efficiency or working efficiency.

The coating film may be dried before, during, or after the irradiation of active energy rays. The timing of the drying process can be appropriately selected in combination with conditions of irradiation with active energy rays. The conditions of drying the surface protective layer can be appropriately selected based on, for example, the type of solvent used in the coating solution and the thickness of the surface protective layer. The drying temperature preferably ranges from room temperature to 180° C. and most preferably from 80° C. to 140° C. The drying period of time preferably ranges from 1 to 200 min and most preferably from 5 to 100 min. The amount of the solvent contained in the surface protective layer can be controlled within a range of 20 to 75 ppm after drying the coating film under the above-described drying conditions.

The photoreceptor described above includes an intermediate layer 1*b* containing a specific metal oxide microparticle 1$b$A and a surface protective layer 1$e$ containing a p-type semiconductor microparticle 1$e$A and thereby can exhibit high memory resistance over a long period of time and can prevent fogging.

Although the details of the reason for compatibility between high memory resistance and prevention of fogging by such a photoreceptor are unclear, both advantageous effects are probably achieved as follows: The specific metal oxide microparticles appropriately enhance the electron transportability of the intermediate layer 1$b$. This enhancement allows the electrons generated in the organic photosensitive layer 1$f$ by, for example, thermal excitation in the use for a long time to be rapidly discharged into the electroconductive support 1$a$ to prevent a decrease in the ability of discharging holes from the organic photosensitive layer 1$f$ to the surface of the photoreceptor. As a result, the initial high memory resistance by a small amount of the p-type semiconductor microparticle 1$e$A that prevents fogging can be maintained even in the use over a long period of time.

[Image Forming Apparatus]

The image forming apparatus of the present invention includes the photoreceptor. The image forming apparatus of the present invention is a general electrophotographic image forming apparatus and is typically composed of, for example, a photoreceptor, a charging unit for charging the surface of the photoreceptor, an exposure unit for forming an electrostatic latent image on the surface of the photoreceptor, a developing unit for developing the electrostatic latent image by toner to form a toner image, a transfer unit for transferring the toner image onto a transfer material, a fixing unit for fixing the toner image transferred on the transfer material, and a cleaning unit for removing the residual toner on the photoreceptor.

Figure 2:
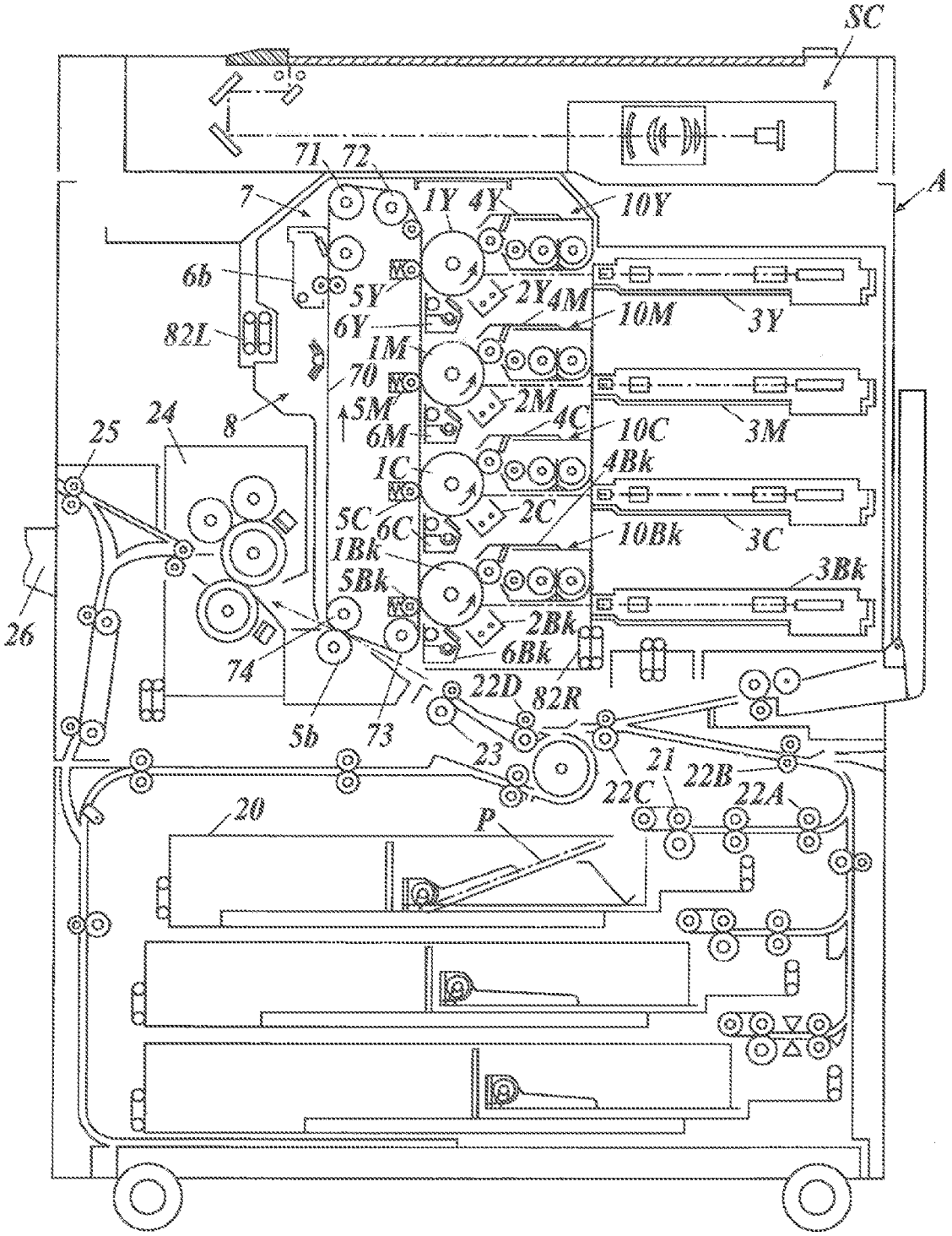
FIG. 2 is a cross-sectional view illustrating the structure of an example image forming apparatus including an electrophotographic photoreceptor of the present invention.

FIG. 2 is a cross-sectional view illustrating the structure of an example image forming apparatus including a photoreceptor of the present invention.

This image forming apparatus is a tandem color image forming apparatus and is composed of four image-forming portions (image-forming units) 10Y, 10M, 10C, and 10Bk; an endless-belt intermediate transfer unit 7; a fed paper conveying unit 21; and a fixing unit 24. An original image scanner SC is disposed at an upper portion of the body A of the image forming apparatus.

The four image-forming units (10Y, 10M, 10C, and 10Bk, respectively) include photoreceptors (1Y, 1M, 1C, and 1Bk) at the center, charging units (2Y, 2M, 2C, and 2Bk), exposure units (3Y, 3M, 3C, and 3Bk), rotatable developing units (4Y, 4M, 4C, and 4Bk), and cleaning units (6Y, 6M, 6C, and 6Bk) for cleaning the photoreceptors (1Y, 1M, 1C, and 1Bk).

In the image forming apparatus of the present invention, at least one of the photoreceptors 1Y, 1M, 1C, and 1Bk is the photoreceptor of the present invention.

The image-forming units 10Y, 10M, 10C, and 10Bk have the same structure except that the photoreceptors 1Y, 1M, 1C, and 1Bk form yellow, magenta, cyan, and black toner images, respectively. The image-forming unit 10Y will, accordingly, be described in detail as an example.

The image-forming unit 10Y includes the charging unit 2Y, the exposure unit 3Y, the developing unit 4Y, and the cleaning unit 6Y disposed in the periphery of the photoreceptor 1Y serving as an image forming body, and forms a yellow (Y) toner image on the photoreceptor 1Y.

The charging unit 2Y applies a uniform potential to the photoreceptor 1Y. In the present invention, the charging unit is of, for example, a contact or non-contact roller charging system.

The exposure unit 3Y exposes the photoreceptor 1Y charged with a uniform potential by the charging unit 2Y based on image signals (yellow) to form an electrostatic latent image corresponding to the yellow image. This exposure unit 3Y is, for example, composed of LEDs disposed such that light-emitting elements are arrayed along the axis of the photoreceptor 1Y and image-forming elements, or is a laser optical system.

The developing unit 4Y is composed of a developing sleeve that includes, for example, built-in magnet and rotates while retaining a developer and a voltage-applying device that applies a DC and/or AC bias voltage between the photoreceptor and the developing sleeve.

The fixing unit 24 is of, for example, a heat roller fixing system that is composed of a heating roller including a heat source therein and a pressurizing roller disposed in a state being pressed to the heating roller so as to form a fixing nip portion.

The cleaning unit 6Y is composed of a cleaning blade and a brush roller disposed upstream of the cleaning blade.

In the image forming apparatus shown in FIG. 2, the photoreceptor 1Y, the charging unit 2Y, the developing unit 4Y, and the cleaning unit 6Y of the image-forming unit 10Y may be integrated as a process cartridge, and this process cartridge may be detachably attached to the apparatus body A on a guide unit such as a rail.

The image-forming units 10Y, 10M, 10C, and 10Bk are disposed in the vertical direction. The endless-belt intermediate transfer unit 7 is disposed on the left of the photoreceptors 1Y, 1M, 1C, and 1Bk in the drawing. The endless-belt intermediate transfer unit 7 is composed of a semiconductive endless-belt intermediate transfer unit 70 moving around the primary transfer rollers 5Y, 5M, 5C, and 5Bk, secondary transfer roller 5$b$, and a plurality of rollers 71, 72, 73, and 74, and the cleaning unit 6$b$.

The image-forming units 10Y, 10M, 10C, and 10Bk and the endless-belt intermediate transfer unit 7 are placed in a housing 8, and the housing 8 is drawable from the apparatus body A on supporting rails 82L and 82R.

The primary transfer roller 5Bk is always in contact with the photoreceptor 1Bk all time during the image forming process. Other primary transfer rollers 5Y, 5M, and 5C come into contact with the photoreceptors 1Y, 1M, and 1C, respectively, only during the formation of the color image.

The secondary transfer roller 5$b$ comes into contact with the endless-belt intermediate transfer unit 70 only during the passing of the transfer material P for secondary transfer.

Although the image forming apparatus shown in FIG. 2 is a color laser printer, the photoreceptor of the present invention can also be applied to monochrome laser printers and copiers. The exposure light source may be a light source other than laser, such as an LED light source.

[Image Forming Process]

The image forming process of the present invention uses the photoreceptor, for example, the image forming apparatus including the photoreceptor.

Specifically, the image-forming units 10Y, 10M, 10C, and 10Bk form toner images of the respective colors. The toner images are successively transferred and superimposed on the endless-belt intermediate transfer unit 70 driven by the primary transfer rollers 5Y, 5M, 5C, and 5Bk to form a color image. The transfer material P (an image support supporting the fixed final image: e.g., plain paper or a transparent sheet) accommodated in a sheet-feeding cassette 20 is supplied by the fed paper conveying unit 21 and is conveyed to the secondary transfer roller 5$b$ through intermediate rollers 22A, 22B, 22C, and 22D and a resist roller 23. The color image is transferred on the transfer material P by secondary transfer. The color image transferred to the transfer material P is fixed by a fixing unit 24. The transfer material P is pinched with paper discharge rollers 25 and is placed on a paper discharge tray 26 outside the apparatus.

Meanwhile, the color image is transferred to the transfer material P by the secondary transfer roller 5*b*. The cleaning unit 6*b* cleans the endless belt intermediate transfer body 70 that has released the transfer object P by self stripping so as to remove residual toner.

[Toner and Developer]

Although the toner used for the image forming apparatus of the present invention may be a pulverized toner or a polymerized toner, in the image forming apparatus according to the present invention, preferred is a polymerized toner produced by polymerization from the viewpoint of forming images with high image quality.

The term "polymerized toner" refers to a toner prepared by simultaneously performing production of a binder resin for a toner and formation of toner particles through polymerization of a raw material monomer for producing the binder resin and subsequent optional chemical treatment.

More specifically, the term "polymerized toner" refers to a toner formed through a step of producing resin microparticles by polymerization, such as suspension polymerization or emulsion polymerization, and then an optional step of fusing the resin microparticles.

The binder resin of the toner used for the image forming apparatus of the present invention is preferably a crystalline resin. The use of a toner containing a crystalline resin as the binder resin can prevent fogging in the resulting images. This is probably achieved by a decrease in the variation of frictional charging of the toner with the developing units 4Y, 4M, 4C, and 4Bk.

The volume-average particle diameter, i.e., 50% volume particle diameter (Dv50), of the toner is desirably 2 to 9 μm and more preferably 3 to 7 μm. In this range, high resolution can be achieved. In addition, although a toner having a volume-average particle diameter within the above-mentioned range has a small particle diameter, the amount of fine toner particles can be reduced, the reproducibility of dot images is improved over a long period of time, and stable images having high sharpness can be formed.

The toner according to the present invention may be used alone as a one-component developer or may be used in combination with a carrier as a two-component developer.

In the use as a one-component developer, for example, the toner can be used as a non-magnetic one-component developer or a magnetic one-component developer containing magnetic particles of about 0.1 to 0.5 μm.

In the use of a two-component developer mixed with a carrier, the magnetic particles of the carrier may be of a known material, for example, a metal, such as iron, ferrite, and magnetite; or an alloy of such a metal with another metal, such as aluminum and lead. The particularly preferred are ferrite particles. The magnetic particles preferably have a volume-average particle diameter of 15 to 100 μm and more preferably 25 to 80 μm.

The volume-average particle diameter of a carrier can be typically measured with a laser diffraction particle size analyzer "HELOS" (manufactured by SYMPATEC GmbH) equipped with a wet disperser.

The carrier is preferably composed of magnetic particles coated with a resin or magnetic particles dispersed in a resin (resin-dispersed carrier). The resin for the coating may be any resin composition. Examples of the resin include olefin resins, styrene resins, styrene-acrylic resins, silicone resins, ester resins, and fluorine-containing polymer resins. The resin constituting the resin-dispersed carrier may be any known resin. Examples of the resin include styrene-acrylic resins, polyester resins, fluororesins, and phenol resins.

The embodiments of the present invention have been specifically described above, but should not be limited to the above-described examples and can be variously modified.

EXAMPLES

The present invention will now be specifically described by way of examples, which should not be construed to limit the present invention.

Surface Treatment Example 1 of Metal Oxide Microparticles

Rutile titanium oxide (500 parts by mass of "MT-500SA": manufactured by Tayca Corporation) having a number-average primary particle diameter of 35 nm, a surface treating agent (65 parts by mass of 3-methacryloxypropyltrimethoxysilane "KBM-503": manufactured by Shin-Etsu Chemical Co., Ltd.), and toluene (1500 parts by mass) were mixed with stirring and were then subjected to wet disintegration with a bead mill for a mill retention time of 25 min at 35° C. to prepare a slurry. Toluene was removed from the slurry by vacuum distillation. The dried product was heated at 120° C. for 2 hours for baking the surface treating agent, followed by pulverization with a pin mill to give metal oxide microparticles [1] of organic-treated rutile titanium oxide.

Surface Treatment Example 2 of Metal Oxide Microparticles

Metal oxide microparticles [2] of organic-treated rutile titanium oxide were prepared as in Surface treatment example 1 of metal oxide microparticles except that the surface treating agent was methyl hydrogen polysiloxane (MHPS): 1,1,1,3,5,5,5-heptamethylsiloxane (manufactured by Shin-Etsu Chemical Co., Ltd.) instead of 3-methacryloxypropyltrimethoxysilane.

Surface Treatment Example 3 of Metal Oxide Microparticles

Metal oxide microparticles [3] of organic-treated anatase titanium oxide were prepared as in Surface treatment example 1 of metal oxide microparticles except that anatase titanium oxide ("JA-1": manufactured by Tayca Corporation) was used instead of rutile titanium oxide.

Surface Treatment Example 4 of Metal Oxide Microparticles

Metal oxide microparticles [4] of organic-treated tin oxide were prepared as in Surface treatment example 1 of metal oxide microparticles except that tin oxide ("CIK": manufactured by Nanotec Corp.) was used instead of rutile titanium oxide.

Surface Treatment Example 5 of Metal Oxide Microparticles

Metal oxide microparticles [5] of organic-treated rutile titanium oxide were prepared as in Surface treatment example 1 of metal oxide microparticles except that the surface treating agent was tristrimethylsiloxysilane (TT- MSS) instead of 3-methacryloxypropyltrimethoxysilane manufactured by Shin-Etsu Chemical Co., Ltd.

Surface Treatment Example 1 of p-Type Semiconductor Microparticles $CuAlO_2$ (100 parts by mass) having a number-average primary particle diameter of 20 nm, a surface treating agent (10 parts by mass of 3-methacryloxypropyltrimethoxysilane "KBM-503": manufactured by Shin-Etsu Chemical Co., Ltd.), and methyl ethyl ketone (1000 parts by mass) were mixed in a wet sand mill (containing 0.5 mm diameter alumina beads) at 30° C. for 6 hours. The methyl ethyl ketone and alumina beads were then removed by filtration, followed by drying at 60° C. to give surface-treated p-type semiconductor microparticles [1].

Surface Treatment Example 2 of p-Type Semiconductor Microparticles

Surface-treated p-type semiconductor microparticles [2] were prepared as in Surface treatment example 1 of p-type semiconductor microparticles except that $CuInO_2$ was used instead of $CuAlO_2$.

Surface Treatment Example 3 of p-Type Semiconductor Microparticles $SrCu_2O_2$ (100 parts by mass) having a number-average primary particle diameter of 30 nm, a surface treating agent (30 parts by mass of 3-methacryloxypropyltrimethoxysilane "KBM-503": manufactured by Shin-Etsu Chemical Co., Ltd.), and methyl ethyl ketone (1000 parts by mass) were mixed in a wet sand mill (containing 0.5 mm diameter alumina beads) at 30° C. for 6 hours. The methyl ethyl ketone and alumina beads were then removed by filtration, followed by drying at 60° C. to give surface-treated p-type semiconductor microparticles [3].

Surface Treatment Example 4 of p-Type Semiconductor Microparticles

Surface-treated p-type semiconductor microparticles [4] were prepared as in Surface treatment example 3 of p-type semiconductor microparticles except that $BaCu_2O_2$ was used instead of $SrCu_2O_2$.

Surface Treatment Example 5 of p-Type Semiconductor Microparticles

Surface-treated p-type semiconductor microparticles [5] were prepared as in Surface treatment example 1 of p-type semiconductor microparticles except that the surface treating agent was 3-methacryloxypropylmethyldimethoxysilane ("KBM-502": manufactured by Shin-Etsu Chemical Co., Ltd.) instead of 3-methacryloxypropyltrimethoxysilane.

Production Example 1 of Photoreceptor (1) Production of Electroconductive Support An electroconductive support [1] was prepared by machining the surface of a cylindrical aluminum support having a diameter of 80 mm.

(2) Formation of Intermediate Layer

The following materials were dispersed with a sand mill functioning as a disperser for 10 hours. The resulting dispersion was diluted two-fold with the same solvent as that in the dispersion. The solution was left to stand overnight and was then filtered through a filter (Rigimesh 5 μm Filter: manufactured by Pall Corporation Japan) to prepare a coating solution [1] for forming an intermediate layer.

| | |
|---|---|
| Polyamide resin "CM8000" (manufactured by Toray Industries, Inc.) | 1 part by mass |
| Metal oxide microparticles [1] | 3 parts by mass |
| Methanol | 10 parts by mass |

The coating solution [1] for forming an intermediate layer was applied onto the surface of the washed electroconductive support [1] by dipping, followed by drying to form an intermediate layer [1] having a dried thickness of 2 μm.

(3) Formation of Charge-Generating Layer (3-1) Preparation of Charge-Generating Material A crude titanyl phthalocyanine was synthesized from 1,3-diiminoisoindoline and titanium tetra-n-butoxide and was dissolved in sulfuric acid. The solution of the crude titanyl phthalocyanine was poured into water to precipitate crystals, followed by filtration. The resulting crystals were sufficiently washed with water to give a wet paste. Subsequently, the wet paste was frozen in a freezer and was then thawed again, followed by filtration and drying to give amorphous titanyl phthalocyanine.

The amorphous titanyl phthalocyanine and (2R,3R)-2,3-butanediol were mixed in o-dichlorobenzene (ODB) at an equivalent ratio of the (2R,3R)-2,3-butanediol to the amorphous titanyl phthalocyanine of 0.6. The mixture was stirred with heating at 60° C. to 70° C. for 6 hours. The resulting solution was left to stand overnight. Methanol was then added to the solution to precipitate crystals, followed by filtration. The resulting crystals were washed with methanol to give charge-generating material [CG-1] of a pigment containing a (2R,3R)-2,3-butanediol adduct of titanyl phthalocyanine.

The X-ray diffraction spectrum of the charge-generating material [CG-1] has peaks at 8.3°, 24.7°, 25.1°, and 26.5°. The results suggest that the charge-generating material [CG-1] is a mixture of a 1:1 adduct of titanyl phthalocyanine and (2R,3R)-2,3-butanediol and a non-adduct of titanyl phthalocyanine.

(3-2) Formation of Charge-Generating Layer

The following materials were mixed and dispersed with a circulation ultrasonic homogenizer "RUS-600TCVP" (manufactured by Nihonseiki Kaisha Ltd., 19.5 kHz, 600 W) at a circulation flow rate of 40 L/hr for 0.5 hours to prepare coating solution [1] for forming a charge-transporting layer.

| | |
|---|---|
| Charge-generating material [CG-1] | 24 parts by mass |
| Polyvinyl butyral resin "S-LEC BL-1" (manufactured by Sekisui Chemical Co., Ltd.) | 12 parts by mass |
| Solvent (methyl ethyl ketone/cyclohexanone = 4/1 (V/V)) | 400 parts by mass |

The coating solution [1] for forming a charge-generating layer was applied onto the intermediate layer [1] by dipping to form a coating film. The coating film was dried into a charge-generating layer [1] having a thickness of 0.5 μm.

(4) Formation of Charge-Transporting Layer

The following materials were mixed and dissolved to prepare a coating solution [1] for forming a charge-transporting layer.

| | |
|---|---|
| Charge-transporting material (4,4'-dimethyl-4''-(β-phenylstyryl)triphenylamine) | 225 parts by mass |
| Binder resin for a charge-transporting layer (polycarbonate resin "Z300" manufactured by Mitsubishi Gas Chemical Company) | 300 parts by mass |
| Antioxidant "Irganox 1010" (manufactured by BASF Japan Ltd.) | 6 parts by mass |
| Solvent (tetrahydrofuran, THF) | 1600 parts by mass |
| Solvent (toluene) | 400 parts by mass |
| Silicone oil "KF-54" (manufactured by Shin-Etsu Chemical Co., Ltd.) | 1 part by mass |

The coating solution [1] for forming a charge-transporting layer was applied onto the charge-generating layer [1] by dipping to form a coating film. The coating film was dried into a charge-transporting layer [1] having a thickness of 20 μm.

(5) Formation of Protective Layer

The following materials were completely dissolved or dispersed with stirring to prepare a coating solution [1] for forming a surface protective layer.

| | |
|---|---|
| p-Type semiconductor microparticles [1] | 100 parts by mass |
| Polymerizable compound (trimethylolpropane trimethacrylate, manufactured by Sartomer) | 100 parts by mass |
| Polymerization initiator "Irgacure 819" (manufactured by BASF Japan Ltd.) | 15 parts by mass |
| Solvent (2-butanol) | 500 parts by mass |

The coating solution [1] for forming a surface protective layer was applied onto the charge-transporting layer [1] with a circular slide hopper applicator and was irradiated with ultraviolet rays from a xenon lamp for 1 min into a protective layer [1] having a dried thickness of 2.0 μm. Photoreceptor [1] was thereby produced.

Production Example 2 of Photoreceptor

Photoreceptor [2] was produced as in Production example 1 of photoreceptor except that metal oxide microparticles [2] were used instead of metal oxide microparticles [1].

Production Example 3 of Photoreceptor

Photoreceptor [3] was produced as in Production example of photoreceptor except that p-type semiconductor microparticles [2] were used instead of p-type semiconductor microparticles [1].

Production Example 4 of Photoreceptor

Photoreceptor [4] was produced as in Production example of photoreceptor except that p-type semiconductor microparticles [3] were used instead of p-type semiconductor microparticles [1].

Production Example 5 of Photoreceptor

Photoreceptor [5] was produced as in Production example of photoreceptor except that p-type semiconductor microparticles [4] were used instead of p-type semiconductor microparticles [1].

Production Example 6 of Photoreceptor

Photoreceptor [6] was produced as in Production example 1 of photoreceptor except that metal oxide microparticles [3] were used instead of metal oxide microparticles [1].

Production Example 7 of Photoreceptor

Photoreceptor [7] was produced as in Production example 1 of photoreceptor except that metal oxide microparticles [4] were used instead of metal oxide microparticles [1].

Production Example 8 of Photoreceptor

Photoreceptor [8] was produced as in Production example of photoreceptor except that surface-untreated anatase titanium oxide "JA-1" (manufactured by Tayca Corporation, metal oxide microparticles [6]) was used instead of metal oxide microparticles [1].

Production Example 9 Photoreceptor

Photoreceptor [9] was produced as in Production example 1 of photoreceptor except that surface-untreated tin oxide "CIK" (manufactured by Nanotec Corp., metal oxide microparticles [7]) was used instead of metal oxide microparticles [1].

Production Example 10 of Photoreceptor

Photoreceptor [10] was produced as in Production example 1 of photoreceptor except that the intermediate layer was formed as follows.

(2) Formation of Intermediate Layer

Polyamide resin (N-1) represented by Formula (N-1) (100 parts by mass) was added to a solvent mixture (ethanol/n-propyl alcohol/tetrahydrofuran in a volume ratio of 45/20/35, 1700 parts by mass), followed by mixing with stirring at 20° C. to prepare a solution. Metal oxide microparticles [1] (97 parts by mass) and metal oxide microparticles [2] (226 parts by mass) were dispersed in the solution with a bead mill for a mill retention time of 5 hours. The dispersion was left to stand for twenty-four hours and was then filtered through a filter (Rigimesh 5 μm Filter: manufactured by Pall Corporation Japan) at a pressure of 50 kPa to prepare a coating solution [2] for forming an intermediate layer.

The coating solution [2] for forming an intermediate layer was applied onto the surface of the washed electroconductive support [1] by dipping, followed by drying at 120° C. for 30 min to form an intermediate layer [2] having a dried thickness of 2 μm.

Formula (N-1)

[Chem. 3]

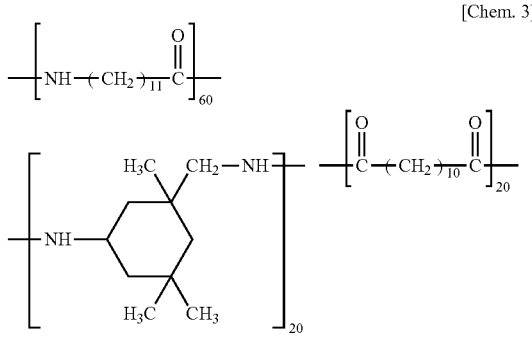

Production Example 11 of Photoreceptor

Photoreceptor [11] was produced as in Production example 10 of photoreceptor except that metal oxide microparticles [3] were used instead of metal oxide microparticles [1] and that metal oxide microparticles [5] were used instead of metal oxide microparticles [2].

Production Example 12 of Photoreceptor

Photoreceptor [12] was produced as in Production example 2 of photoreceptor except that p-type semiconductor microparticles [5] were used instead of p-type semiconductor microparticles [1].

Production Example 13 of Photoreceptor

Photoreceptor [13] was produced as in Production example 1 of photoreceptor except that the intermediate layer and the surface protective layer were formed as follows.

(2) Formation of Intermediate Layer

The following materials were dispersed with a circulation wet disperser. The resulting dispersion was left to stand for twenty-four hours and was then filtered through a filter (Rigimesh 5 μm Filter: manufactured by Pall Corporation Japan) at a pressure of 50 kPa to prepare a coating solution [3] for forming an intermediate layer.

Polyamide resin (N-1): 10 parts by mass

Surface-untreated rutile titanium oxide particles (metal oxide microparticles [8]): 30 parts by mass Methanol: 90 parts by mass Ethanol: 5 parts by mass The coating solution [3] for forming an intermediate layer was applied onto the surface of the washed electroconductive support [1] by dipping, followed by drying at 120° C. for 30 min to form an intermediate layer [3] having a dried thickness of 2 μm.

(5) Formation of Surface Protective Layer

The following materials were completely dissolved or dispersed with stirring to prepare a coating solution [2] for forming a surface protective layer.

Tin oxide surface-treated with 3-methacryloxypropyltrimethoxysilane: 150 parts by mass Polymerizable compound (trimethylolpropane trimethacrylate, manufactured by Sartomer): 100 parts by mass Polymerization initiator "Irgacure 819" (manufactured by BASF Japan Ltd.): 12.5 parts by mass Solvent (2-butanol): 320 parts by mass The coating solution [2] for forming a surface protective layer was applied onto the charge-transporting layer [1] with a circular slide hopper applicator and was irradiated with ultraviolet rays from a metal halide lamp for 1 min into a surface protective layer [2] having a dried thickness of 3.0 μm. Photoreceptor [13] was thereby produced.

Production Example 14 of Photoreceptor

Photoreceptor [14] was produced as in Production example 13 of photoreceptor except that metal oxide microparticles [6] were used instead of metal oxide microparticles [8].

Production Example 15 of Photoreceptor

Photoreceptor [15] was produced as in Production example 13 of photoreceptor except that metal oxide microparticles [4] were used instead of metal oxide microparticles [8].

Production Example 16 of Photoreceptor

Photoreceptor [16] was produced as in Production example 13 of photoreceptor except that metal oxide microparticles [1] were used instead of metal oxide microparticles [8].

Production Example 17 of Photoreceptor

Photoreceptor [17] was produced as in Production example 13 of photoreceptor except that metal oxide microparticles [2] were used instead of metal oxide microparticles [8].

Examples 1 to 12 and Comparative Examples 1 to 5

Commercially available full color multifunctional printer "bizhub PRO C8000" (manufactured by Konica Minolta, Inc.) was modified to give a printing rate of 120 sheets/min. Photoreceptors [1] to [17] were each mounted on the printer such that the same photoreceptors were used for a set of colors and were evaluated.

A durability test was performed by continuous print of a text image having an image area ratio of 6% on both sides of 10000 sheets of size A4 paper in an environment of 23° C. and 50% RH. After the durability test, image memory and fogging were evaluated.

(1) Evaluation of Image Memory

After the durability test, an image including solid black and solid white portions was continuously printed on 10 sheets of paper. Subsequently, a uniform half tone image was continuously printed on 5 sheets of paper and was visually observed for the occurrence of history of the solid black and the solid white portions (occurrence of image memory) to evaluate by the following criteria. Table 1 shows the results.

Evaluation Criteria

R5: no image memory in all half tone images (acceptable)

R4: no image memory in the fifth half tone image, although the first to fourth half tone images having slight visible image memory (acceptable)

R3: slight image memory not causing practical problems in the fifth half tone image (acceptable)

R2: distinct image memory causing practical problems in the first to fourth half tone images (rejected)

R1: distinct image memory in all half tone images (rejected)

(2) Evaluation of Fogging

After the durability test, an unused transfer material "POD Gloss Coat" (size A3, 100 g/m$^2$) (manufactured by Oji Paper Co., Ltd.) was transferred to the position of the black, and a solid white image was formed at a grid voltage of −800 V and a developing bias of −650 V. The transfer material was visually observed for fogging. Similarly, a solid yellow image was formed at a grid voltage of −800 V and a developing bias of −650 V, and the transfer material was visually observed for fogging. The criteria for the evaluation are as follows. Table 1 shows the results.

Evaluation Criteria

R5: no fogging in both the solid white image and the solid yellow image (acceptable)

R4: slight fogging not causing practical problems in either the solid white image or the solid yellow image in magnifying observation (acceptable)

R3: fogging not causing practical problems in both the solid white image and the solid yellow image in magnifying observation (acceptable)

R2: slight fogging in either the solid white image or the solid yellow image in visual observation (rejected)

R1: distinct fogging in either the solid white image or the solid yellow image (rejected)

TABLE 1

| | | Metal oxide microparticles in intermediate layer | | | p-Type semiconductor microparticles | | | Results of evaluation | |
|---|---|---|---|---|---|---|---|---|---|
| | Photoreceptor No. | No. | Type | Surface treating agent | No. | Type | Surface treating agent | Image memory | Fogging |
| Example 1 | [1] | [1] | Rutile titanium oxide | KBM-503 | [1] | $CuAlO_2$ | KBM-503 | R5 | R4 |
| Example 2 | [2] | [2] | Rutile titanium oxide | MHPS | [1] | $CuAlO_2$ | KBM-503 | R4 | R3 |
| Example 3 | [3] | [1] | Rutile titanium oxide | KBM-503 | [2] | $CuInO_2$ | KBM-503 | R4 | R3 |
| Example 4 | [4] | [1] | Rutile titanium oxide | KBM-503 | [3] | $SrCu_2O_2$ | KBM-503 | R4 | R4 |
| Example 5 | [5] | [1] | Rutile titanium oxide | KBM-503 | [4] | $BaCu_2O_2$ | KBM-503 | R4 | R3 |
| Example 6 | [6] | [3] | Anatase titanium oxide | KBM-503 | [1] | $CuAlO_2$ | KBM-503 | R5 | R3 |
| Example 7 | [7] | [4] | Tin oxide | KBM-503 | [1] | $CuAlO_2$ | KBM-503 | R3 | R3 |
| Example 8 | [8] | [6] | Anatase titanium oxide | None | [1] | $CuAlO_2$ | KBM-503 | R4 | R3 |
| Example 9 | [9] | [7] | Tin oxide | None | [1] | $CuAlO_2$ | KBM-503 | R3 | R3 |
| Example 10 | [10] | [1] | Rutile titanium oxide | KBM-503 | [1] | $CuAlO_2$ | KBM-503 | R5 | R5 |
| | | [2] | Rutile titanium oxide | MHPS | | | | | |
| Example 11 | [11] | [3] | Anatase titanium oxide | KBM-503 | [1] | $CuAlO_2$ | KBM-503 | R4 | R4 |
| | | [5] | Rutile titanium oxide | TTMSS | | | | | |
| Example 12 | [12] | [2] | Rutile titanium oxide | MHPS | [5] | $CuAlO_2$ | KBM-502 | R3 | R3 |
| Comparative Example 1 | [13] | [8] | Rutile titanium oxide | None | | None | | R2 | R1 |
| Comparative Example 2 | [14] | [6] | Anatase titanium oxide | None | | None | | R1 | R1 |
| Comparative Example 3 | [15] | [4] | Tin oxide | KBM-503 | | None | | R1 | R2 |
| Comparative Example 4 | [16] | [1] | Rutile titanium oxide | KBM-503 | | None | | R1 | R2 |
| Comparative Example 5 | [17] | [2] | Rutile titanium oxide | MHPS | | None | | R1 | R2 |

The entire disclosure of Japanese Patent Application No. 2015-020132 filed on Feb. 4, 2015 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An electrophotographic photoreceptor comprising:

an intermediate layer;

a photosensitive layer; and a surface protective layer, deposited in this order on an electroconductive support, wherein the surface protective layer includes a resin and a p-type semiconductor microparticle contained in the resin, wherein the p-type semiconductor microparticle is surface-treated with a first surface treating agent having a first reactive organic group and is made of a compound represented by Formula (1) or Formula (2):

$$CuM^1O_2 \qquad \text{Formula (1):}$$

wherein $M^1$ represents an element belonging to Group 13 on a periodic table, $$M^2Cu_2O_2 \qquad \text{Formula (2):}$$

wherein $M^2$ represents an element belonging to Group 2 on the periodic table;

the intermediate layer includes a resin and at least one metal oxide microparticle contained in the resin, wherein the at least one metal oxide microparticle is surface-treated with a second surface treating agent having a second reactive organic group and is selected from the group consisting of anatase titanium oxide particles and rutile titanium oxide particles; and the first surface treating agent is the same as the second surface treating agent.

2. The electrophotographic photoreceptor according to claim 1, wherein the resin constituting the surface protective layer is a cured resin prepared by polymerization of a crosslinkable polymerizable compound.

3. The electrophotographic photoreceptor according to claim 2, wherein the crosslinkable polymerizable compound is a polymerizable monomer at least having an acryloyl group or a methacryloyl group.

4. The electrophotographic photoreceptor according to claim 1, wherein the metal oxide microparticle contained in the intermediate layer is further surface-treated with an inorganic oxide.

5. An electrophotographic image forming apparatus comprising the electrophotographic photoreceptor according to claim 1.

6. An electrophotographic image forming process, the process comprising use of the electrophotographic photoreceptor according to claim 1.

7. The electrophotographic photoreceptor according to claim 1, wherein the p-type semiconductor microparticle is made of the compound represented by the Formula (2).

* * * * *